US005318289A

United States Patent [19]

Mahoney et al.

[11] Patent Number: 5,318,289

[45] Date of Patent: Jun. 7, 1994

[54] BREAKOVER BASKETBALL GOAL RELEASE MECHANISM

[75] Inventors: Kenneth J. Mahoney; Thomas H. Mahoney, both of Dorrance, Kans.; Dana G. Rosenburg, Grand Island, Nebr.

[73] Assignee: Gared Sports, Inc., St. Louis, Mo.

[21] Appl. No.: 622,479

[22] Filed: Dec. 5, 1990

[51] Int. Cl.[5] ..... A63B 63/08

[52] U.S. Cl. ..... 273/1.5 R

[58] Field of Search ..... 273/1.5 R; 172/266, 172/267, 265

[56] References Cited

U.S. PATENT DOCUMENTS

| | | | |
|---|---|---|---|
| 47,153 | 4/1865 | Murphy | 172/266 |
| 158,081 | 12/1874 | Hewett | 172/267 |
| 247,756 | 10/1881 | Grissinger | 172/267 |
| 895,587 | 8/1908 | Putney | 172/267 |
| 1,068,832 | 7/1913 | Alsop | 172/266 |
| 2,565,668 | 8/1951 | Simpson | 172/267 |
| 4,534,556 | 8/1985 | Estlund et al. | 273/1.5 R |
| 4,676,503 | 6/1987 | Mahoney et al. | 273/1.5 R |

FOREIGN PATENT DOCUMENTS

| | | | |
|---|---|---|---|
| 2483733 | 12/1981 | France | 172/267 |

*Primary Examiner*—Paul E. Shapiro

*Attorney, Agent, or Firm*—Phillip A. Rein

[57] ABSTRACT

A breakover basketball goal release mechanism attached to a basketball backboard member so that a basketball rim member is automatically pivoted when an excessive pressure is applied and, after breakover, resets itself. The breakover basketball goal release mechanism includes: 1) a main support base assembly; 2) a basketball rim and support assembly pivotally connected along one edge to the main support base assembly; and 3) a breakover actuator assembly operably mounted between the main support base assembly and the basketball rim and support assembly. The breakover actuator assembly includes a breakover arm assembly having upper and lower breakover arm members which, when closely aligned with each other, prevents release of the basketball rim member until a preset pressure is applied. The breakover actuator assembly operates to cushion movement of the basketball member rim to the breakover condition. A second embodiment achieves superior breakover pressure release and adjustment features.

8 Claims, 5 Drawing Sheets

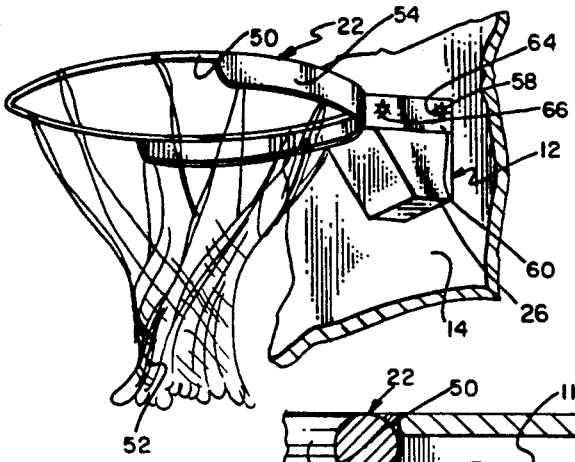
FIG. 1
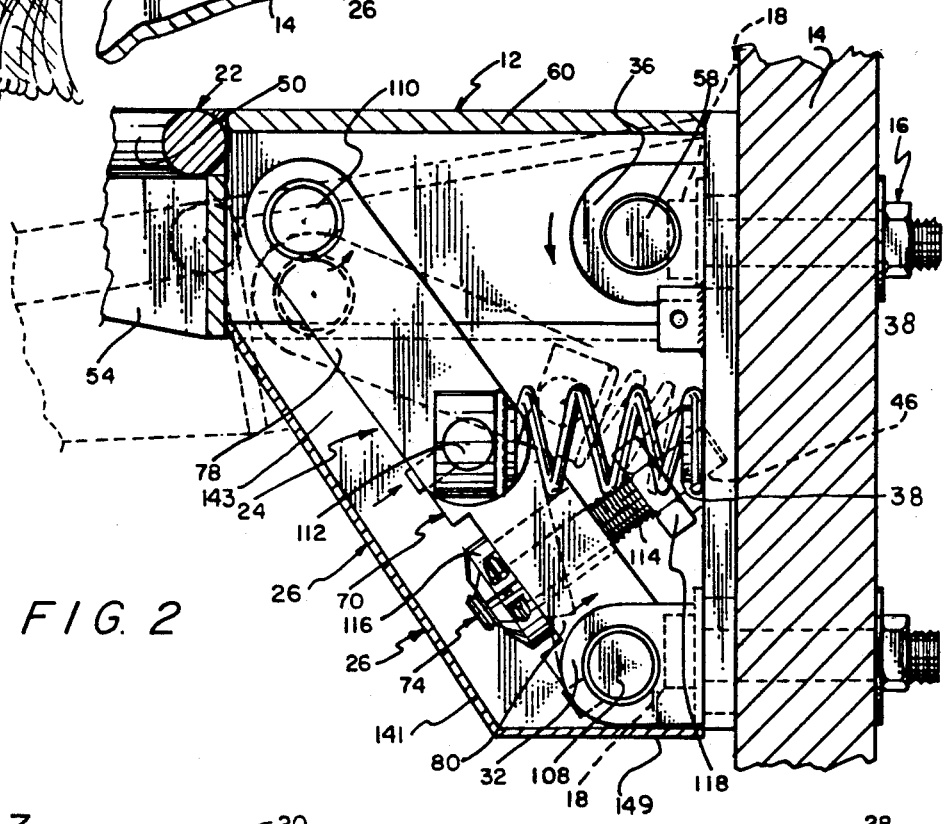
FIG. 2
FIG. 3
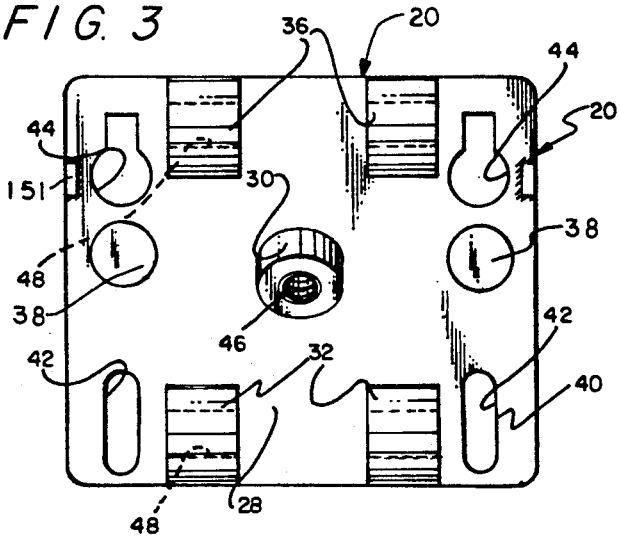
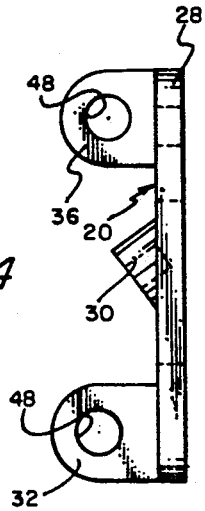
FIG. 4

FIG. 15
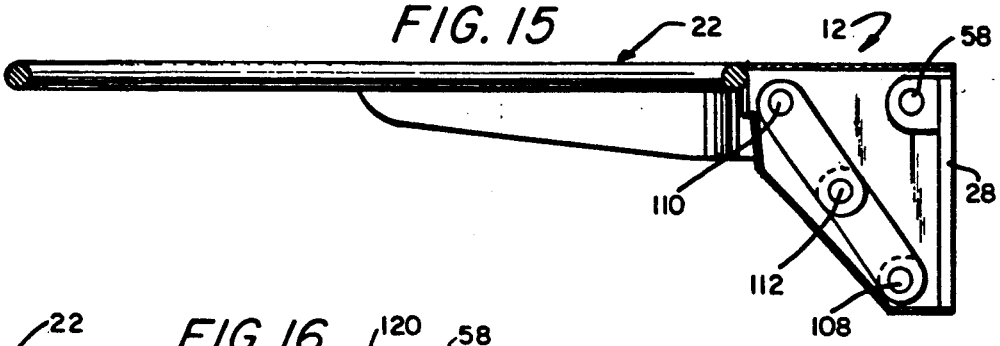
FIG. 16
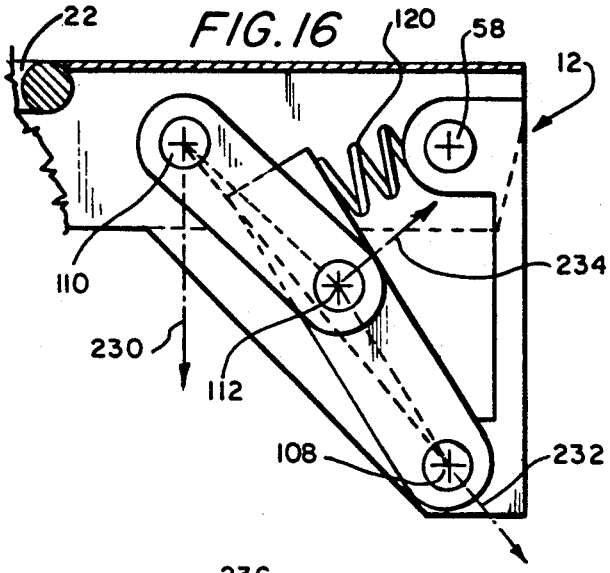
FIG. 17
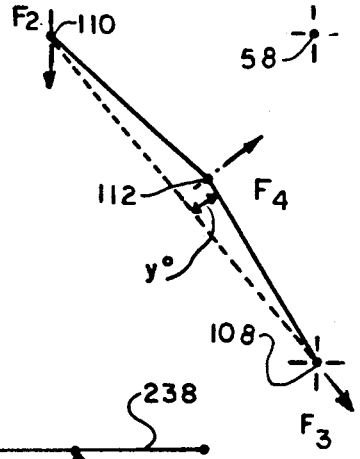
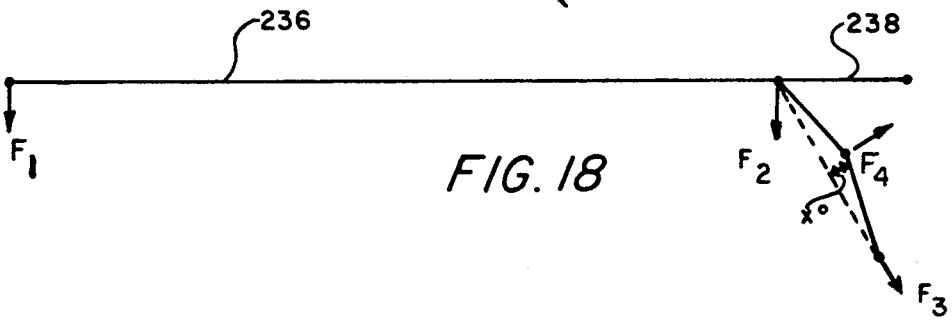
FIG. 18
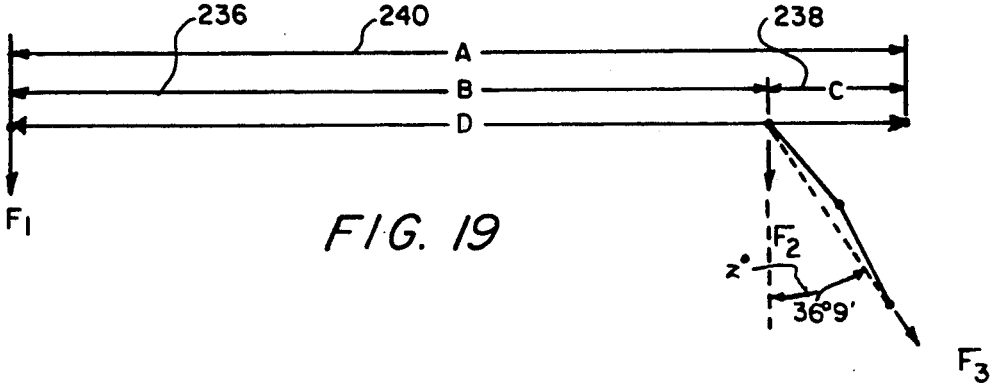
FIG. 19

BREAKOVER BASKETBALL GOAL RELEASE MECHANISM

PRIOR ART

The applicant herein is very knowledgable in the area of basketball goal release mechanisms used to release a basketball goal rim when excessive pressure is applied thereto such as in a slam dunk basketball exhibition. The basketball goal release mechanism is used primarily to prevent breakage of a glass basketball backboard member. As the applicant is educated in this area and presently manufacturing basketball goal release mechanisms, a patent search was not conducted but the following prior art patents relative to this field are as follows:

| Reg. No. | Patent Date | Inventor |
|---|---|---|
| 75,669 | Mar 1868 | Turk |
| 339,632 | Apr 1886 | Eubanks |
| 1,167,122 | Jan 1916 | Simmons |
| 2,935,144 | May 1960 | Graham |
| 4,411,420 | Sep 1978 | Tyner |
| 4,365,802 | Dec 1982 | Ehrat |
| 4,534,556 | Aug 1985 | Estlund et al |
| R10927 | Jun 1956 | Fed. Rep. of Germany |
| 1247726 | Aug 1967 | Fed. Rep. of Germany |
| 1296916 | May 1962 | France |
| 90883 | Nov 1937 | Sweden |
| 1462352 | Jan 1977 | United Kingdom |

It is believed that none of these references are pertinent to applicant's invention herein which applies to an entirely new method of operation over the known prior art structure being a "breakover" rather than a "breakaway" mode of operation.

PREFERRED EMBODIMENTS OF THE INVENTION

In one preferred embodiment of a breakover basketball goal release mechanism is provided to be attached to a glass basketball backboard member to prevent breakage therof on applying an overload condition to a basketball rim member. The breakover basketball goal release mechanism includes: 1) a main support base assembly which is attached as by nut and bolt members to the basketball backboard member; 2) a basketball rim and support assembly including the basketball rim member and being pivotally connected to the main support base assembly; 3) a breakover actuator assembly operably connected between the main support base assembly and the basketball rim and support assembly; and 4) an access cover member connected to the main support base assembly operable to enclose the breakover actuator assembly. The breakover actuator assembly includes: 1) a breakover arm assembly; 2) a breakover adjustment assembly operable to engage the breakover arm assembly and to adjust the release pressure of the basketball rim member; and 3) a breakover biasing assembly operable to maintain the breakover arm assembly and the basketball rim member in a horizontal position under the normal basketball playing conditions. The breakover biasing assembly is operable on release of the breakover arm assembly to automatically return the basketball rim member to the normal horizontal basketball playing condition. The breakover arm assembly is provided with upper and lower breaker arm members which are 1) pivotally connected to each other; 2) the upper breaker arm is pivotally connected to the basketball rim and support assembly; and 3) a lower end of the lower break arm assembly is pivotally connected to the main support base assembly. The breakover actuator assembly is operable to maintain the basketball rim member in a solid rigid condition until a preset excessive pressure is applied thereto which, then, provides for its immediate release for automatic return of the basketball rim member to the horizontal basketball playing condition.

In a second preferred embodiment of this invention, a breakover basketball goal release mechanism is provided to be attached to a glass basketball board member to prevent breakage thereof similar to the first embodiment. This breakover basketball goal release mechanism includes 1) a main base support assembly which is attached to the basketball backboard member; 2) a basketball rim and support assembly identical to that in the first embodiment; 3) an actuator breakover assembly operably connected between the main base support assembly and the basketball rim and support assembly; and 4) an access cover member identical to that in the first embodiment. The actuator breakover assembly includes 1) a main breakover arm assembly; 2) an arm connector assembly; 3) an arm adjustment assembly to adjust release pressures of the main breakover arm assembly; and 4) a bias breakover assembly operable to maintain the main breakover arm assembly and the basketball rim member in a horizontal position under the normal basketball playing conditions. The breakover bias assembly is operable on release of the main breakover arm assembly to automatically return the basketball rim to the normal horizontal basketball playing condition. The main breakover arm assembly includes 1) first and second breakover arm members which are pivotal to each other; 2) the first breakover arm assembly is pivotally connected to the basketball rim and support assembly; and 3) a lower end of the second breakover arm member is pivotally connected to the main base support assembly. The first and second breakover arm members are adapted to abut each other in the normal non-release condition and to breakover on the application of excessive pressure to the basketball rim member.

OBJECTS OF THE INVENTION

One object of this invention is to provide a breakover basketball goal release mechanism which can be mounted on any basektball backboard member and being operable to automatic release, on excessive pressure thereto applied, a basketball rim member and then return the basketball rim member to the normal horizontally extended basketball playing condition.

One other object of this invention is to provide a breakover basketball goal release machanism which resembles a normal basketball rim and support assembly but having a unique mechanism therein for downward pivotal movement of a basketball rim member on application of excessive pressure while maintaining continuous linkage connection between a main support base assembly and the pivotal basketball rim member.

Another object of this invention is to provide a breakover basketball goal release mechanism having a basketball rim and support assembly having a basketball rim member pivotal about a main support shaft member but being a solid rigid structure without fluttering effect until a preset adjustable excessive pressure is applied thereto and having a breakover biasing assembly which increases pressure on the basketball rim member on pivotal movement so as to aid in the basketball player's retaining control after experiencing a slam dunk basketball shot and, perhaps, subsequent pivotal movement of the basketball rim member.

A further object of this invention is to provide a second embodiment of a breakover basketball goal release mechanism including a new and novel breakover actuator assembly using a linkage assembly having pivotally connected upper and lower breakover arm members which, in turn, are pivotally connected respectfully to a main base support assembly and a basketball rim member so as to provide continuous connection thereto thus reducing maintenance problems.

Still, one other object of this invention is to provide a breakover basketball goal release mechanism which is sturdy in construction; new and novel in operation; substantially maintenance free; adjustable and reliable in repeat release pressure operation; and easy to install.

Various other objects, advantages, and features of the invention will become apparent to those skilled in the art from the following discussion, taken in conjunction with the accompanying drawings, in which:

FIGURES OF THE INVENTION

FIG. 1 is a fragmentary perspective view of a basketball backboard member having a breakover basketball goal release mechanism of this invention connected thereto;

FIG. 2 is a fragmentary side elevational view with portions broken away of the basketball backboard member and the breakover basketball goal release mechanism connected thereto and showing movement of a basketball rim and support assembly to a breakover condition as indicated in dotted lines;

FIG. 3 is a front elevational view of a main support base assembly of the breakover basketball goal release mechanism of this invention;

FIG. 4 is a side elevational view of the main support base assembly illustrated in FIG. 3;

FIG. 15 is a schematic diagram of the breakover basketball goal release mechanism illustrating pivotal part relationships;

FIG. 16 is a fragmentary sectional schematic of the breakover basketball goal release mechanism illustrating an application of breakover forces; and FIGS. 17, 18, and 19 are schematic diagrams illustrating force and leverage vectors.

Figure 5:
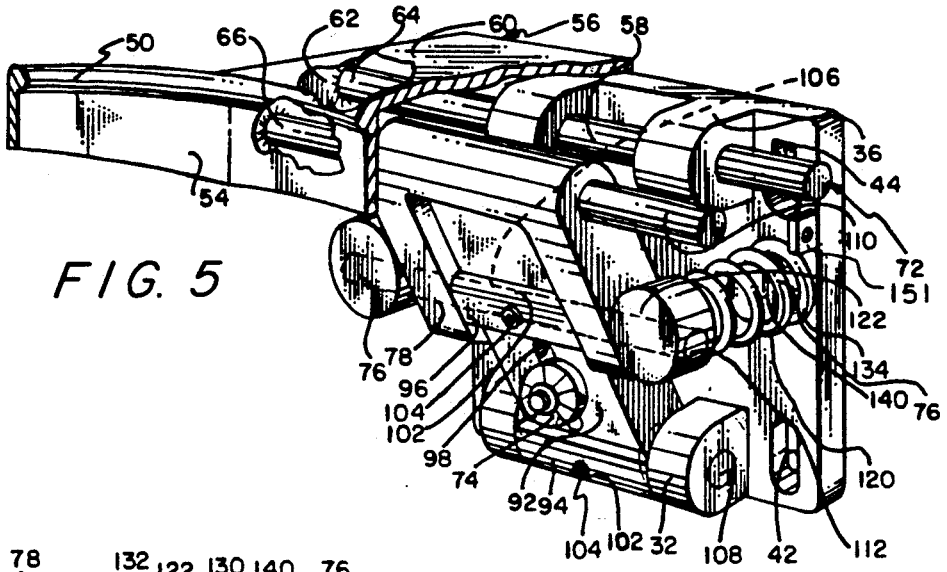
FIG. 5 is a fragmentary perspective view of the breakover basketball goal release mechanism of this invention having portions thereof broken away for clarity.

The following is a discussion and description of preferred specific embodiments of the new breakover basketball goal release mechanism of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

FIRST EMBODIMENT—FIGS. 1-8

On referring to the drawings in detail and, in particular to FIG. 1, a breakover basketball goal release mechanism, indicated generally at 12, is shown as attached to a basketball backboard member 14 by a connector assembly 16. The connector assembly 16 includes a plurality, namely 4, nut and bolt members 18. The purpose of the breakover basketball goal release mechanism 12 is to provide a means of releasing a basketball rim member when excessive pressure is applied thereto such as occurs when slam dunking a basketball member and the player grabs the basketball rim member.

The breakover basketball goal release mechanism 12 includes: 1) a main support base assembly 20; 2) a basketball rim and support assembly 22 pivotally connected to the main support base assembly 20; 3) a breakover actuator assembly 24 pivotally mounted between the main support assembly 20 and the basketball rim and support assembly 22; and 4) an access cover member 26 releasably connected to the main support base assembly 20 and operable to enclose the breakover actuator assembly 24.

As best illustrated in FIGS. 3 and 4, the main support base assembly 20 includes a support base assembly 28; an adjustment lug 30 extended from the center of the support base member 28; spaced pairs of shaft support lugs 32, 36 extended outwardly along upper and lower edges of the support base member 28; a pair of spaced spring boss members 38. The support base member 28 is of a generally rectangular plate structure having connector openings 40 therein. The connector openings 40 include a pair of slot openings 42, a pair of spaced key-shaped openings 44 for ease of mounting and operable to receive the connector assembly 16 therein for anchoring to the basketball backboard member 14.

The adjustment lug 30 is inclined downwardly and having a central threaded opening 46 therein for reasons to be explained.

The pair of shafts support lugs 32, 36 are each provided with respective pairs of aligned shaft openings 48 therein for pivotal connection to the breakover actuator assembly 24 as will be noted.

The spring boss members 38 are adapted to receive spring members therebout and prevent their lateral movement therefrom.

As noted in FIG. 1, the basketball rim and support assembly 22 includes: 1) a conventional basketball rim member 50; 2) a net member 52 connected to and downwardly extending from the basketball rim member 50; 3) a rim flange member 54 extended about and downwardly extended from a portion of the basketball rim member 50 adjacent to the basketball backboard member 14; 4) a connector housing 56 which is connected to a rear portion of the basketball rim member 50 and the rim flange member 54 as welding or the like; and 5) a main support shaft member 58 which is operably connected to the connector housing 56 and the shaft support lugs 36 in a manner to be explained.

The connector housing 56 includes a top support plate 60 having opposite sides integral with downward extending parallel side support plates 62. The side support plates 62 are each provided with a stationary shaft opening 64 and a pivotal shaft opening 66. The stationary shaft openings 64 are designed to receive opposite ends of the main support shaft 58 therein to provide a point of pivotal movement of the entire basketball rim and support assembly 22 as will be explained in the use and operation of this invention.

The breakover actuator assembly 24 includes: 1) a breakover arm assembly 70; 2) a breakover arm connector assembly 72 to pivotally connect the breakover arm assembly 70 as will be noted; 3) a breakover adjustment assembly 74 operably connected to the main support base assembly 20 and the breakover arm assembly 70; and 4) a breakover biasing assembly 76 mounted between the main support base assembly 20 and the breakover arm assembly 70. The breakover arm assembly 70 includes an upper breakover arm member 78 pivotally connected at adjacent ends thereof to a lower breakover arm member 80.

Figure 8:
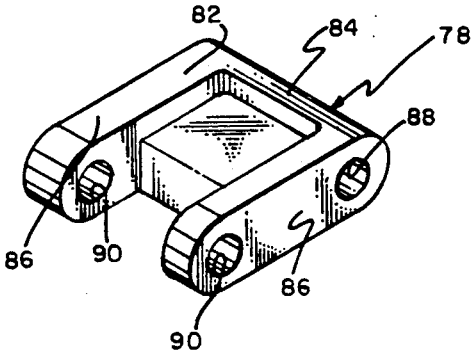
FIG. 8 is a perspective view of an upper breakover arm member of a breakover actuator assembly of the breakover basketball goal release mechanism of this invention.
Figure 9:
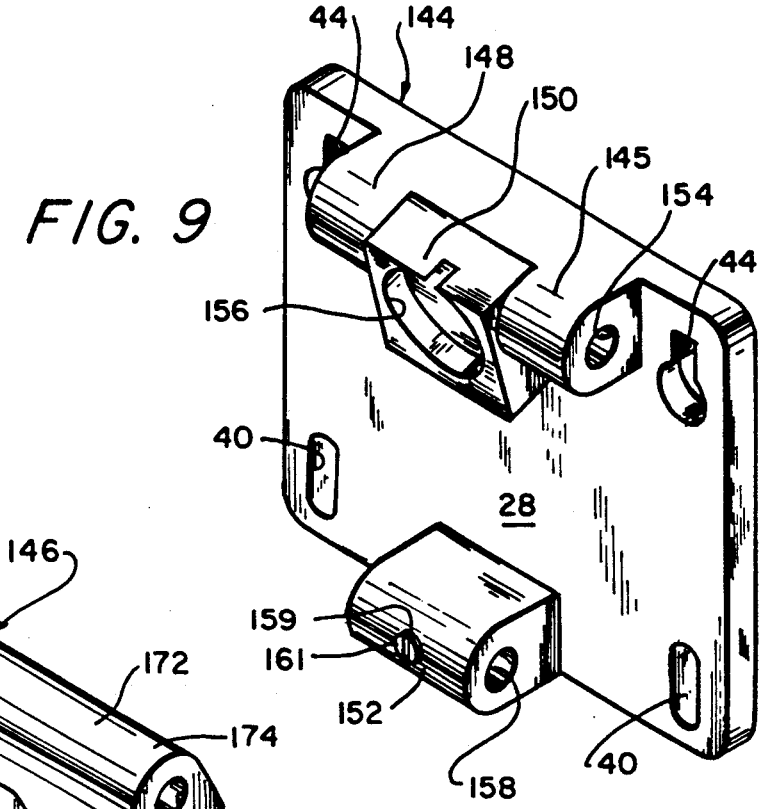
FIG. 9 is a perspective view of a main base support assembly of a second embodiment of the breakover basketball goal release mechanism of this invention.
Figure 10:
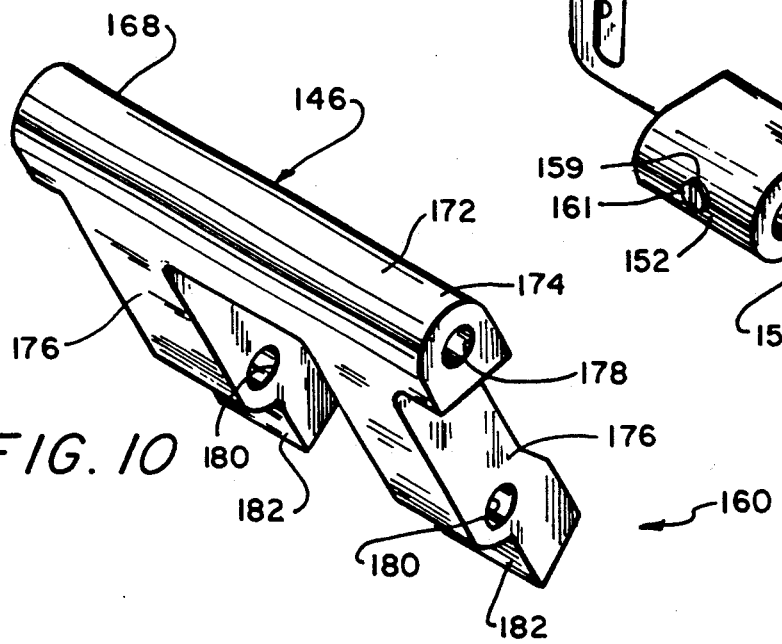
FIG. 10 is a perspective view of a first breakover arm member of the second embodiment of this invention.

As best noted in FIG. 8, the upper breakover arm member 78 includes a U-shaped main arm body 82. The main arm body 82 includes a base section 84 integral with spaced parallel leg sections 86. The base section 84 has a shaft support opening 88 therein for pivotal connection to the basketball rim and support assembly 22 as will be noted.

The parallel leg sections 86 are each provided with a shaft opening 90 which are aligned with each other for pivotal connection to the lower breakover arm member 80.

As noted in FIG. 5, the lower breakover arm member 80 is provided with a main arm body section 92 having integral end connector sections 94 and 96 at opposite ends of the main arm body section 92. The main arm body section 92 is provided with an adjustment slot 98 to receive the breakover adjustment assembly 74 therethrough as will be explained.

Each of the end connector sections 94 and 96 are provided with a lock screw opening 102 to receive a lock screw member 104 therein; and a shaft support opening 106.

The breakover arm connector assembly 72 includes: 1) a stationary support shaft 108 mounted through the shaft openings 48 in the spaced shaft support lugs 32 and the shaft support opening 106 in the end connector section 94; 2) a rim support shaft 110 mounted through the shaft support opening 88 in the base section 84 and the pivotal shaft openings 66 in the side support plates 62; and 3) an intermediate support shaft 112 mounted within the shaft support opening 106 in the end connector section 96; the aligned shaft openings 90 in the leg sections 86; and pivotally connected to the breakover biasing assembly 76 as will be explained.

The breakover adjustment assembly 74 includes an adjustment bolt member 114 having one end threadedly mounted within the threaded opening 46 in the adjustment lug 30; an adjustment cap member 116 threaded and mounted on an opposite end of the adjustment bolt member 114; and a lock member 118 mounted on the adjustable bolt member 114 and engagable with an outer surface of the adjustment lug 30 as noted in FIG. 2 for locking purposes.

The breakover biasing assembly 76 includes a pair of spaced identical spring load assemblies 120. Each spring load assembly 120 includes: 1) an alignment actuator cap 122; 2) a biasing member 124 mounted between the main support base assembly 20 and the alignment actuator cap 122; and 3) a compression member 126 mounted within the confines of the biasing member 124 for reasons to be explained.

Figure 7:
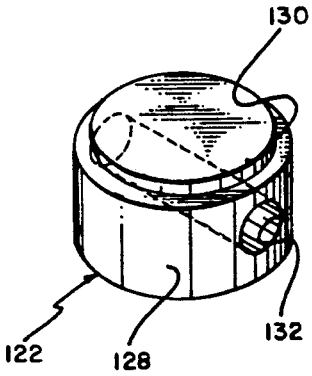
FIG. 7 is a perspective view of an alignment actuator cap of the spring load assembly.

As noted in FIG. 7, each alignment actuator cap 122 includes a main cap body 128 having a spring groove 130 about one end and centrally thereof provided with an anchor opening 132 which is adapted to receive the intermediate support shaft 112 therein when in the assembled condition.

Figure 6:
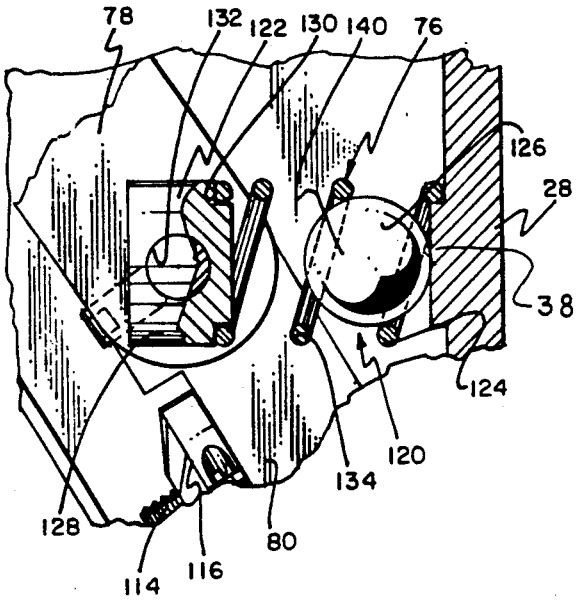
FIG. 6 is an enlarged fragmentary side elevational view illustrating a spring load assembly of the breakover basketball goal release mechanism with portions thereof broken away for clarity.

The biasing member 124 includes a compression spring member 134 having one end mounted within the spring groove 130 in the respective alignment actuator cap 122 and the opposite end thereof is adapted to be placed about the respective spring boss member 38 as noted in FIG. 6.

The access cover member 26 provides a protective cover about the breakover actuator assembly 24 and includes a front wall 141 with integral side walls 143 all of which are integral with a bottom wall 145. A pair of anchor screws are operable to attach the access cover member 26 to spaced support lugs 151 on the main support base assembly 20.

SECOND EMBODIMENT—FIGS. 9-14

In the second embodiment of this invention, a breakover basketball goal release assembly 142 is provided to be utilized with the basketball rim and support assembly 22 and mounted on a basketball backboard member 14 with an outward appearance identical to that noted in FIG. 1 of the first embodiment. The breakover basketball goal release assembly 142 includes 1) a main base support assembly 144 which is secured by the connector assembly 16 to the basketball backboard member 14; 2) a basketball rim and support assembly 22 (as previously described) which is attached to the main base support assembly 144; 3) an actuator breakover arm assembly 146 which is mounted between the basketball rim and support assembly 22 and the main base support assembly 44; and 4) an access cover member 26 which is adapted to protect and enclose the actuator breakover assembly 146 being identical to that previously described for the first embodiment.

The main base support assembly 144 includes a support base member 28 having adjustment and support lugs 145 connected thereto. The support base member 28 is substantially identical to that described in the first embodiment having the connector opening 40 and the key hole openings 44 in a spaced relationship.

The adjustment and support lugs 145 include a lug housing 148; a spring housing 150; and an arm support lug 152. The lug housing 148 has a shaft connector hole 154 therethrough. The spring housing 150 is provided with a spring cutout opening 156 for reasons to become obvious.

The arm support lug 152 is provided with a shaft support hole 158 and an anchor screw opening 159 adapted to receive an anchor screw member 161 therein.

The actuator breakover assembly 146 includes 1) a main breakover arm assembly 160; 2) an arm connector assembly 162; 3) an arm adjustment assembly 164; and 4) a bias breakover assembly 166. The main breakover arm assembly 160 includes a first breakover arm member 168 and a second breakover arm member 170.

The first breakover arm assembly 168 includes a "U" shaped main arm member 172 having a main base section 174 with integral laterally extended parallel leg lug sections 176. The main base section 174 is provided with a shaft opening 178 extended longitudinally thereof. Each of the leg lug sections 176 is provided with an aligned intermediate shaft opening 180 and an abuttment surface 182.

Figure 11:
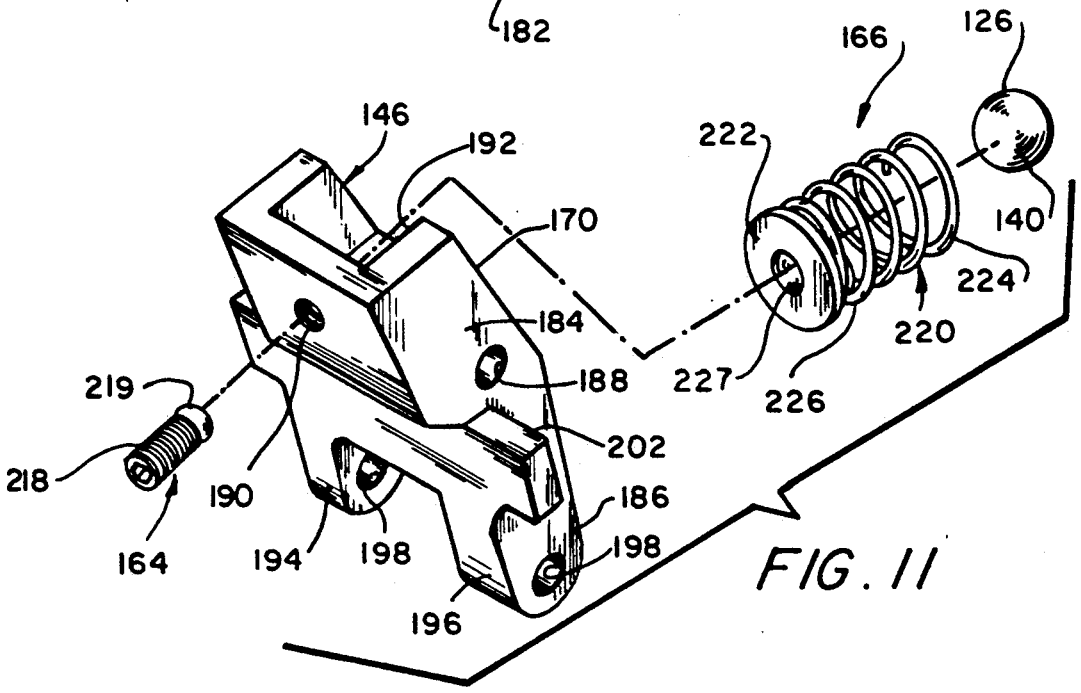
FIG. 11 is an exploded view of a second breakover arm member and a breakover biasing assembly of the second embodiment.

The second breakover arm assembly 170, as noted in FIG. 11, includes a main body section 184 having integral therewith an end support lug 186. The main body section 184 is provided with a shaft anchor opening 188; an adjustment screw opening 190; and a spring receiver open area 192.

The end support lug 186 is provided with adjacent parallel end connector lugs 194, 196. Each end connector lug 194, 196 is provided with a stationary shaft support opening 198 and a base abuttment surface 202 which will contact a respective abuttment surface 182 in a manner to be described.

Figure 13:
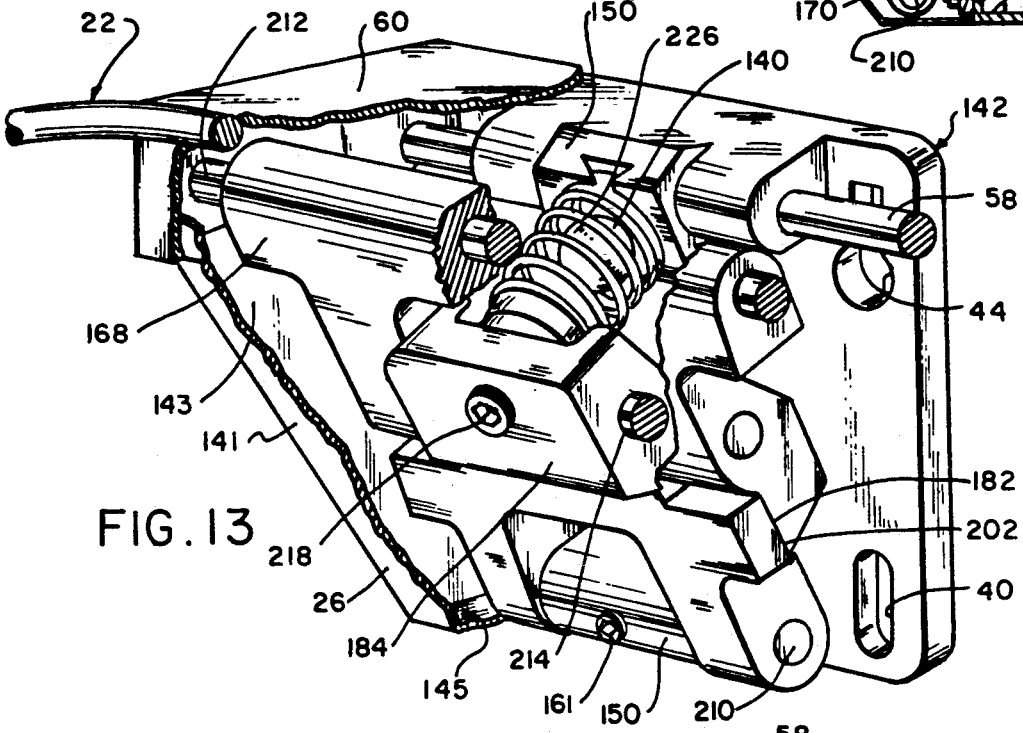
FIG. 13 is a fragmentary perspective view of the second embodiment of this invention having portions thereof broken away for clarity.

As noted in FIG. 13, the arm connector assembly 162 includes a stationary support shaft member 210; a rim support shaft member 212; and an intermediate support shaft member 214. The stationary support shaft member 210 is extended through the stationary shaft openings 198 in the end support lugs 186 and the shaft support hole 158 in the arm support lug 152. The rim support shaft member 212 is placed in the shaft opening 178 in the main arm member 172 and the pivotal shaft openings 66 in the side support plates 62 of the basketball rim and support assembly 22.

The intermediate support shaft 214 is extended within the alignment intermediate shaft openings 180 in the main arm member 172 and the shaft anchor opening 188 in the second breakover arm member 170.

The arm adjustment assembly 164 includes a threaded adjustment screw 218 which is mounted within the adjustment screw opening 190 in the second breakover arm member 170. The adjustment screw 218 is provided with an arculate end section 219 to cooperate with the bias breakover assembly 166.

As noted in FIG. 11, the bias breakover assembly 166 includes a spring bias assembly 220. More particularly, the spring bias assembly 220 includes 1) a spring compression member 222; 2) a biasing member 224; and 3) a compression member 126. The spring compression member 222 has an indentation 227 to receive the arcuate end section 219 of the adjustment screw 218 therein. The biasing member 224 consists of a compression spring 226.

The compression member 126 is identical to that set forth in the first embodiment being a resilient ball member 140.

It is noted that the first and second embodiments of the breakover basketball goal release mechanism of this invention are substantially identical in function and operation whereupon the first embodiment utilizes two (2) separate breakover bias assemblies whereas it has been found in the second embodiment that a single bias breakover assembly would be sufficient. Additionally, in the second embodiment of the breakover basketball goal release mechanism, a pair of opposed positive abuttment surfaces are utilized on the first and second breakover arm members which provides additional repeat quality control of the overall function of this invention, namely, the release of the basketball rim and support assembly on reaching a predetermined and adjustable force acting on an outer portion of the basketball rim member.

USE AND OPERATION OF THE INVENTION

In the use and operation of the first embodiment of the invention, the breakover basketball goal release mechanism 12 is secured to the basketball backboard member 14 by the connector assembly 16. Limited adjustment of the main support base assembly 20 to the basketball backboard member 14 can be accomplished due to the slot openings 42 and key hole openings 44. The key hole openings 44 are important as the nut and bolt members can be first inserted in the proper holes in the backboard member 14. The breakover basketball goal release mechanism 12 can be elevated to place the upper nut and bolt members 18 through the large hole portions of the key hole openings 44. The breakover basketball goal release mechanism 12 is then lowered about the nut and bolt members 18 which provides vertical support. The other nut and bolt members 18 can be inserted in the respective slot openings 42 and all of the nut and bolt members 18 can then be tightened.

The lock set screw members 104 are respectively tightened onto the stationary support shaft 108 and the intermediate support shaft 112 to anchor in the positions shown in FIG. 5.

Next, the breakover adjustment assembly 74 provides for movement of the adjustment cap member 116 on the adjustment bolt 114 to adjustably move the breakover arm assembly 70 against the breakover biasing assembly 76. This allows the angle of inclination of the upper and lower breakover arm members 78 and 80 to be adjusted relative to each other and adjust the breakover force applied to the basketball rim member 50 for the actuation of the breakover actuator assembly 24. By this adjustment feature, the force desired to cause pivotal movement of the basketball rim member 50 may be adjusted through the use of the breakover adjustment assembly 74.

The breakover actuator assembly 24 of this invention will not operate if the axes of the support shafts 108, 110, and 112 lie in a common line as presents a rigid structure between the upper and lower breakover arm members 78, 80. The axis of intermediate support shaft 112 must be positioned to the right of a line drawn between the axes of the support shafts 108 and 110 (FIG. 15) to achieve the breakover function of this invention. In fact, the further the axis of the intermediate support shaft 112 is adjusted to the right from the line through the axes of the support shafts 108 and 110, the less force is required to breakover and cause downward pivotal movement of the basketball rim member 50 as noted on dotted lines in FIG. 2.

In the use and operation of the second embodiment of this invention being the breakover basketball goal release mechanism 142, it is secured in a manner to the basketball backboard member 14 as described in the first embodiment.

Figure 14:
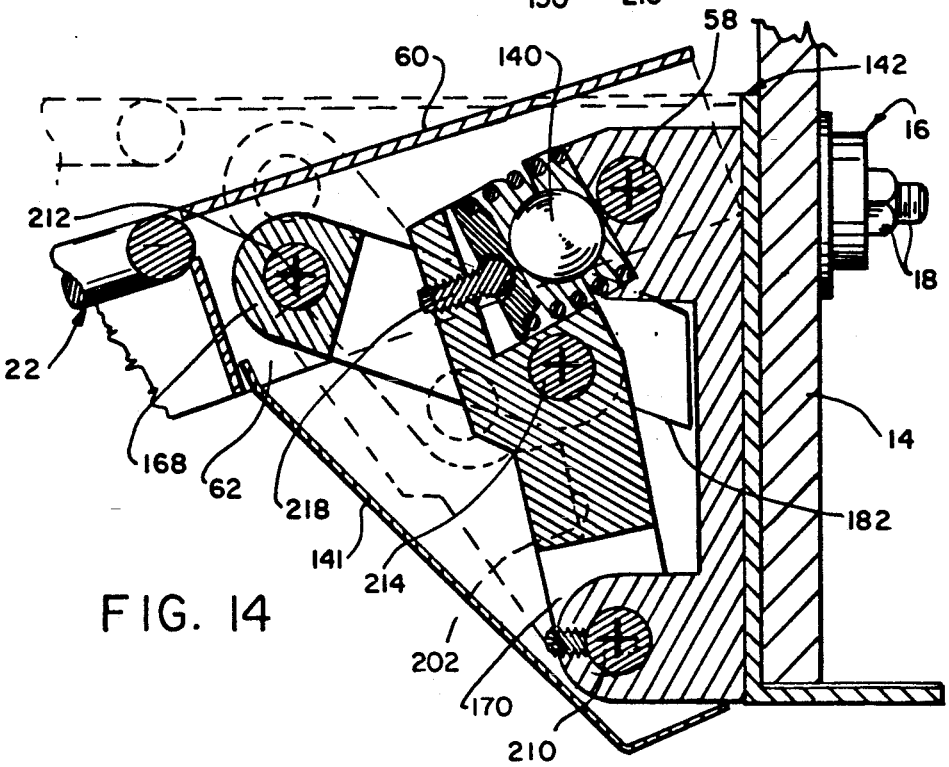
FIG. 14 is a fragmentary sectional view of the second embodiment in a breakover condition with a normal basketball playing condition illustrated in dotted lines.

The bias breakover assembly 166 is adjustable on axial movement of the adjustment screw 218 to increase or decrease the force of compression spring 226 against the second breakover arm member 170 as noted in FIGS. 13 and 14.

Figure 12:
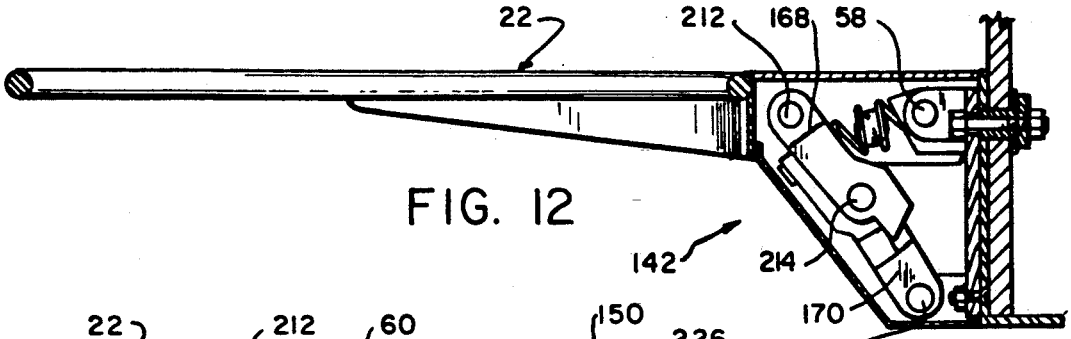
FIG. 12 is a fragmentary side elevational view with portions broken away of a basketball backboard member and the second embodiment of the breakover basketball goal release mechanism.

The angular relationship of the first breakover arm member 168 to the second breakover arm member 170 is set by contact of the abuttment surfaces 182 and 202 when in the basketball playing condition as shown in FIG. 12. In this position, a line drawn through the axes of the shaft members 210 and 212 would place the axes of intermediate support shaft member 214 to the right of subject line as viewed in FIG. 12.

If the axes of the shafts 210, 212, and 214 were in a straight line or shaft 14 was positioned to the left thereof, the main breakover arm assembly 160 would be a rigid structure and not perform the function of this invention.

In actual use of the breakover basketball goal release mechanism 12 in the National Basketball Association playing conditions, the force applied to the outer portion of the basketball rim member 50 is preferrably set to release at an applied pressure of 230 pounds and over. On reaching the excessive force, this force has overcome the frictional resistance and combination resistance of the spring load assembly 120 or spring bias assembly 220 whereupon the breakover condition is achieved and the basketball rim member 50 is moved downwardly as indicated by dotted lines in FIG. 2. Due to the nature of the spring load assembly 120 and the spring bias assembly 220, this provides an increasing resistance to downward movement even on receiving the overload condition so that the basketball rim member 50 still has a feeling of support to the basketball player who has caused its release. This aids the players in stabilizing themselves after the slam dunk procedure has been accomplished and prevents possible resultant injury.

In the first embodiment, it is noted that the resilient ball member 140 acts as a shock absorber on compression of the spring member 134 when the ball member 140 is engaged by an inner surface of the alignment actuator cap 122. This also provides an additional shock absorbing feature of this invention to prevent injury to the breakover basketball goal release mechanism 20 and, of course, the player causing the overload release situation. This also occurs with the compression spring 126, spring compression member 222, and the ball member 140 in the second embodiment.

In the operation of the breakover basketball goal release mechanism 12 of this invention as noted collectively in FIGS. 15–19, cantilever principles are involved with a fixed point at the main support shaft 58 and a downward force applied at F1 on the basketball rim member 50. This results in a concurrent force applied at the rim support shaft 110 which is transferred through the breakover arm assembly 70 to cause "breakover" of the breakover basketball goal release mechanism 12. In order to calculate the forces involved, a conventional basketball rim and support assembly 22 with a force of 230 pounds applied to an outer end of the basketball rim member 50 is used with the following facts:

Distance "A" at 240 equals 23.250 inches
Distance "B" at 236 equals 19.821 inches
Distance "C" at 238 equals 3.429 inches
Distance "D" equals B plus C or distance A.
F1 force to breakover equals 230 lbs.
F2 equals unknown resultant force at rim support shaft 110

Mathematical Formula $$A \times F1 = C \times F2$$

$$23.250 \times 230 = 3429 \times F2$$

$$\frac{23.250 \times 230}{3.429} = F2$$

F2 = 1,560 lbs. sq. inch

In order to determine the breakover pressure at F3 and F4, the angular relationship of a line through support shafts 108 and 110 is indicated a Z degrees being 36.9 degrees. Now, with the angle indicated at X degrees set at 2 degrees and 22.5 minutes, we can calculate the unknown forces F3 and F4.

$$\text{Cosine of Angle } Z \text{ degrees} = \frac{F2}{F3}$$

$$F3 = \frac{1560}{.80748}$$

F3 = 1931 lbs sq. inch

From known tables, the coefficient of friction at the angle X degrees or 2 degrees 22½ minutes is 12.1. The formula is as follows:

$$F2 = F4 \times \text{Coefficient}$$

$$F2 = F4 \times 12.1$$

$$1931 = F4 \times 12.1$$

F4 = 160 lbs sq. inch

F4 = 160 lbs sq. inch without internal friction

However, on actual testing of the force F4 with a force of 230 lbs at F1, found F4 to actually be 58 lbs sq. inch which indicates the internal friction to be (160-58) or 102 lbs sq. inch. This is the balanced point between the force of 230 lbs at F1 and the pressure at F4 on the breakover actuator assembly 24 when the basketball rim member 50 remains in the horizontal basketball playing condition.

An example of a breakover condition as achieved on application of 240 lbs at F1 results in the following:

$$A \times F1 = C \times F2$$

$$623.250 \times 240 = 3.429 \times F2$$

$$\frac{23.250 \times 240}{3.429} = F2$$

F2 = 1627 lbs sq. inch $$\text{Cosine of Angle } Z \text{ degrees} = \frac{F2}{F3}$$

$$F3 = \frac{1627}{.80748}$$

F3=2015 lbs sq. inch $F2 = F4 \times \text{Coefficient}$ $F2 = F4 \times 12.1$ $2015 = F4 \times 12.1$ F4=167 lbs. sq. inch This is a greater force than the F4 at a 230 lb force at F1 and causes the breakover of the breakover actuator assembly 24. As the angle Z degrees then increases at breakover, the internal friction decreases and the force F4 is now being absorbed in the breakover biasing assembly 76 until force F1 is relieved. The biasing assembly 76 then returns the basketball rim member 50 to the horizontal basketball playing conditions.

The forces acting in the second embodiment of the breakover basketball goal release mechanism 142 and formulas used to figure forces at F2 or 230; F3 or 232; and F4 or 234 are identical. In the second embodiment, the angle Z degrees is set by contact of the abuttment surfaces 182 and 202.

It is seen that the breakover basketball goal release mechanism of this invention is unique in operation and maintains the moving linkage parts in a solid continuity condition to prevent excessive wear thereon. The breakover basketball goal release mechanism is sturdy in construction; reliable in forces to cause breakover conditions; and substantially maintenance free.

While the invention has been described in conjunction with preferred specific embodiments thereof, it will be understood that this description is intended to illustrate and not to limit the scope of the invention, which is defined by the following claims.

I claim:

1. A breakover basketball goal release mechanism secured to a basketball backboard member to prevent damage thereto when excessive pressure is applied to a basketball rim member, comprising:

a) a main support base assembly connected to the basketball backboard member;

b) a basketball rim and support assembly including said basketball rim member connected to a connector housing, said connector housing pivotally connected to said main support base assembly;

c) a breakover actuator assembly connected to said main support base assembly and said connector housing and pivotally movable into a folded condition on an excessive pressure being applied to said basketball rim member;

d) said breakover actuator assembly includes a breakover arm assembly having an upper breakover arm member pivotally connected at adjacent ends to a lower breakover arm member;

e) another end of said upper breakover arm member pivotally connected to said connector housing;

f) another end of said lower breakover arm member pivotally connected to said main support base assembly;

g) said upper breakover arm member and said lower breakover arm member movable at interconnected said adjacent ends toward said main support base assembly when moved to said folded condition on excessive pressure being applied to said basketball rim member;

h) said breakover actuator assembly includes a breakover biasing assembly connected to said breakover arm assembly to hold said upper breakover arm member and said lower breakover arm member in a substantially aligned condition to hold said basketball rim member in a horizontal basketball game playing condition;

i) said breakover biasing assembly includes a compression spring member mounted between said main support base assembly and said breakover arm assembly to hold same in said substantially aligned condition; and j) said breakover biasing assembly includes a compression member mounted within said compression spring member operable to be engaged and acts as a shock absorber on movement of said breakover arm assembly to said folded condition.

2. A breakover basketball goal release mechanism secured to a basketball backboard member to prevent damage thereto when excessive pressure is applied to a basketball rim member, comprising:

a) a main support base assembly connected to the basketball backboard member;

b) a basketball rim and support assembly including said basketball rim member connected to a connecting housing, said connector housing pivotally connected to said main support base assembly;

c) a breakover actuator assembly connected to said main support base assembly and said connector housing and pivotally movable into a folded condition on an excessive pressure being applied to said basketball rim member;

d) said breakover actuator assembly includes a breakover arm assembly having an upper breakover arm member pivotally connected at adjacent ends to a lower breakover arm member;

e) another end of said upper breakover arm member pivotally connected to said connector housing;

f) another end of said lower breakover arm member pivotally connected to said main support base assembly;

g) said upper breakover arm member and said lower breakover arm member movable at interconnected said adjacent ends toward said main support base assembly when moved to said folded condition on excessive pressure being applied to said basketball rim member;

h) said upper breakover arm member and said lower breakover arm member pivotally interconnected by an intermediate support shaft; and i) said breakover actuator assembly includes a breakover biasing assembly including an actuator cap connected to respective opposite outer ends of said intermediate support shaft and a biasing member mounted between each respective one of said actuator caps and said main support base assembly to hold said basketball rim member in a horizontal basketball game playing condition.

3. A breakover basketball goal release mechanism secured to a basketball backboard member to prevent damage thereto when excessive pressure is applied to a basketball rim member, comprising:

a) a main support base assembly connected to the basketball backboard member;

b) a basketball rim and support assembly including said basketball rim member connected to a connector housing, said connector housing pivotally connected to said main support base assembly c) a breakover actuator assembly connected to said main support base assembly and said connector housing and pivotally movable into a folded condition on an excessive pressure being applied to said basketball rim member;

d) said breakover actuator assembly includes a breakover arm assembly having an upper breakover arm member pivotally connected at adjacent ends to a lower breakover arm member;

e) another end of said upper breakover arm member pivotally connected to said connector housing;

f) another end of said lower breakover arm member pivotally connected to said main support base assembly;

g) said upper breakover arm member and said lower breakover arm member movable at interconnected said adjacent ends toward said main support base assembly when moved to said folded condition on excessive pressure being applied to said basketball rim member; and h) said breakover actuator assembly includes a breakover adjustment assembly having an adjustment member connected between said breakover arm assembly and said main support base assembly operable to adjust longitudinal alignment between said upper breakover arm member and said lower breakover arm member;

whereby longitudinal axes alignment of said upper breakover arm member and said lower breakover arm member presents a locked condition and misalignment of said longitudinal axes presents the breakover condition of said basketball rim member on excessive pressure being applied thereto.

4. A breakover basketball goal release mechanism secured to a basketball backboard member to prevent damage thereto when excessive pressure is applied to a basketball rim member, comprising;

a) a main support base assembly connected to the basketball backboard member;

b) a basketball rim and support assembly including said basketball rim member connected to a connector housing, said connector housing pivotally connected to said main support base assembly;

c) a breakover actuator assembly connected to said main support base assembly and said connector housing and pivotally movable into a folded condition on an excessive pressure being applied to said basketball rim member;

d) said breakover actuator assembly includes a breakover arm assembly connected by a breakover arm connector assembly to said main support base assembly and said connector housing;

e) said breakover arm assembly includes an upper breakover arm member pivotally connected at adjacent ends to a lower breakover arm member;

f) said breakover arm connector assembly includes 1) a support shaft pivotally connecting another end of said lower breakover arm member to said main support base assembly; 2) a rim support shaft pivotally connecting another end of said upper breakover arm member to said connector housing; and 3) an intermediate support shaft pivotally connecting said adjacent ends of said upper breakover arm member to said lower breakover arm member;

g) said breakover actuator assembly includes a breakover biasing assembly mounted between said main support base assembly and said intermediate support shaft to bias said upper breakover arm member and said lower breakover arm member toward an aligned condition to place said basketball rim member in a horizontal basketball game playing condition;

h) said breakover biasing assembly includes a compression spring member mounted between each opposite end of said intermediate support shaft and said main support base assembly and a resilient compression member mounted within the confines of each compression spring member;

whereby said compression members are engaged and compressed on movement of said basketball rim member to a folded condition to act as shock absorbers.

5. A breakover basketball goal release mechanism secured to a basketball backboard member to prevent damage thereto when excessive pressure is applied to a basketball rim member, comprising:

a) a main support base assembly connected to the basketball backboard member;

b) a basketball rim and support assembly including said basketball rim member connected to a connector housing, said connector housing pivotally connected to said main support base assembly;

c) a breakover actuator assembly connected to said main support base assembly and said connector housing and pivotally movable into a folded condition on an excessive pressure being applied to said basketball rim member;

d) said breakover actuator assembly includes a breakover arm assembly connected by a breakover arm connector assembly to said main support base assembly and said connector housing;

e) said breakover arm assembly includes an upper breakover arm member pivotally connected at adjacent ends to a lower breakover arm member;

f) said breakover arm connector assembly includes 1) a support shaft pivotally connecting another end of said lower breakover arm member to said main support base assembly; 2) a rim support shaft pivotally connecting another end of said upper breakover arm member to said connector housing; and 3) an intermediate support shaft pivotally connecting said adjacent ends of said upper breakover arm member to said lower breakover arm member; and g) said breakover actuator assembly includes a breakover adjustment assembly connected to said lower breakover arm member and said main support base assembly and selectively adjustable to vary an alignment of a longitudinal axis between said upper breakover arm member and said lower breakover arm member;

whereby adjustment of the alignment of the longitudinal axis regulates a force required against said basketball rim member to move same in a breakover condition.

6. A breakover basketball goal release mechanism mountable on a basketball backboard member to prevent breakage thereof during basketball game play, comprising:

a) a main base support assembly connected to said basketball backboard member;

b) a basketball rim and support assembly including a basketball rim member secured to a connector housing which, in turn, is pivotally connected to said main base support assembly;

c) an actuator breakover assembly having a main breakover arm assembly mounted between said connector housing and said main base support assembly operable in one condition to prevent movement of said basketball rim member and operable in an adjusted condition to achieve folding movement of said main breakover arm assembly on a predetermined force applied to said basketball rim member;

d) said main breakover arm assembly includes a first breakover arm member pivotally connected at one end to said connector housing, a second breakover arm member pivotally connected at one end to said main base support assembly, and means pivotally connecting adjacent other ends of said first and second breakover arm members; and e) said bias breakover assembly includes a compression member mounted within said biasing member acting as a shock absorber.

7. A breakover basketball goal release mechanism secured to a basketball backboard member to prevent damage thereto when excessive pressure is applied to a basketball rim member, comprising:

a) a main support base assembly connected to the basketball backboard member;

b) a basketball rim and support assembly including said basketball rim member connected to a connector housing, said connector housing pivotally connected to said main support base assembly;

c) a breakover actuator assembly connected to said main support base assembly and said connector housing and pivotally movable into a folded condition on an excessive pressure being applied to said basketball rim member;

d) said breakover actuator assembly includes a breakover arm assembly having an upper breakover arm member pivotally connected at adjacent ends to a lower breakover arm member;

e) another end of said upper breakover arm member pivotally connected to said connector housing;

f) another end of said lower breakover arm member pivotally connected to said main support base assembly;

g) said upper breakover arm member and said lower breakover arm member movable at interconnected said adjacent ends toward said main support base assembly when moved to said folded condition on excessive pressure being applied to said basketball rim member;

h) said breakover actuator assembly includes a breakover biasing assembly connected to said breakover arm assembly to hold said upper breakover arm member and said lower breakover arm member in a substantially aligned condition to hold said basketball rim member in a horizontal basketball game playing condition;

i) said breakover biasing assembly includes a compression member mounted within a compression spring member operable to be engaged and acts as a shock absorber on movement of said breakover arm assembly to said folded condition; and j) said compression member is a resilient ball member.

8. A breakover basketball goal release mechanism secured to a basketball backboard member to prevent damage thereto when excessive pressure is applied to a basketball rim member, comprising:

a) a main support base assembly connected to the basketball backboard member;

b) a basketball rim and support assembly including said basketball rim member connected to a connector housing, said connector housing pivotally connected to said main support base assembly;

c) a breakover actuator assembly connected to said main support base assembly and said connector housing and pivotally movable into a folded condition on an excessive pressure being applied to said basketball rim member;

d) said breakover actuator assembly includes a breakover arm assembly having an upper breakover arm member pivotally connected at adjacent ends to a lower breakover arm member;

e) another end of said upper breakover arm member pivotally connected to said connector housing;

f) another end of said lower breakover arm member pivotally connected to said main support base assembly;

g) said upper breakover arm member and said lower breakover arm member movable at interconnected said adjacent ends toward said main support base assembly when moved to said folded condition on excessive pressure being applied to said basketball rim member;

h) said breakover actuator assembly includes a breakover adjustment assembly having an adjustment member connected between said breakover arm assembly and said main support base assembly operable to adjust longitudinal alignment between said upper breakover arm member and said lower breakover arm member; and i) said adjustment member is selectively operable to move said longitudinal axis of said upper breakover arm member out of alignment with said longitudinal axis of said lower breakover arm member to adjust an amount of force applied to said basketball rim member to move said breakover arm assembly to the folded condition;

whereby longitudinal axes alignment of said upper breakover arm member and said lower breakover arm member presents a locked condition and misalignment of said longitudinal axes presents the breakover condition of said basketball rim member on excessive pressure being applied thereto and the greater a degree of misalignment of said longitudinal axes of said upper breakover arm member and said lower breakover arm member, the less force required against said basketball rim member to move same to the breakover condition.

* * * * *